United States Patent [19]

Hisey

[11] 3,969,859

[45] July 20, 1976

[54] PREFABRICATED BUILDING LOG SECTIONS

[75] Inventor: Thomas Bruce Hisey, Thornhill, Canada

[73] Assignee: Homestead Logs Limited, Thornhill, Canada

[22] Filed: Feb. 14, 1975

[21] Appl. No.: 550,086

Related U.S. Application Data

[63] Continuation-in-part of Ser. No. 467,340, May 6, 1974, abandoned.

[52] U.S. Cl. ..... 52/233; 52/403; 52/726; 52/593

[51] Int. Cl.[2] ..... E04B 1/10

[58] Field of Search ..... 52/233, 403, 726, 593, 52/595

[56] References Cited

UNITED STATES PATENTS

| | | | |
|---|---|---|---|
| 1,545,173 | 7/1925 | Trost | 62/589 |
| 2,021,341 | 11/1935 | Ward | 62/233 |
| 2,040,110 | 5/1936 | Tahvonen | 62/220 |
| 3,517,471 | 6/1970 | Lindmark | 62/233 |

FOREIGN PATENTS OR APPLICATIONS

| | | | |
|---|---|---|---|
| 92,191 | 1/1922 | Austria | 52/753 L |
| 1,373,787 | 4/1964 | France | 52/233 |
| 367,977 | 4/1921 | Germany | 52/753 L |
| 376,741 | 1/1922 | Germany | 52/753 L |
| 129,688 | 4/1946 | Sweden | 52/233 |
| 227,754 | 9/1943 | Switzerland | 52/595 |
| 249,310 | 6/1947 | Switzerland | 52/595 |
| 374,816 | 3/1964 | Switzerland | 52/233 |

*Primary Examiner*—John E. Murtagh
*Attorney, Agent, or Firm*—David W. Wong; Arne I. Fors

[57] ABSTRACT

A log structure for prefabricated log sections suitable for constructing log buildings is shown herein. The log section has a substantially flat longitudinal upper surface. A pair of spaced parallel longitudinal tongues is formed in the middle portion of the upper surface and these tongues extend radially upwardly from the upper surface. Also, two raised platforms are formed on the longitudinal edge portions of the upper surface. The platforms have a substantially flat upper face. The log section also has a flat lower surface with a pair of spaced parallel longitudinal channels formed in the middle portion therein. The channels have a complementary cross sectional configuration equal to that of the tongues and have cross sectional dimensions at equal to or larger than that of the tongues. A center bore is formed throughout the entire length of the log section. A circular groove and two diametrically opposite radial grooves are formed at the end surfaces of the log section. Two log sections may be joined longitudinally by interfitting the tongues of the lower log section with the channels of the upper log section. A space is formed in the joint, which is filled with sufficient sealing material to seal and bond the joint. Two log sections are joined end-to-end by the provision of a coupler fitted in the circular and radial grooves of the log end. The coupler forms a seal and barrier in the end joint.

10 Claims, 3 Drawing Figures

FIG. 1
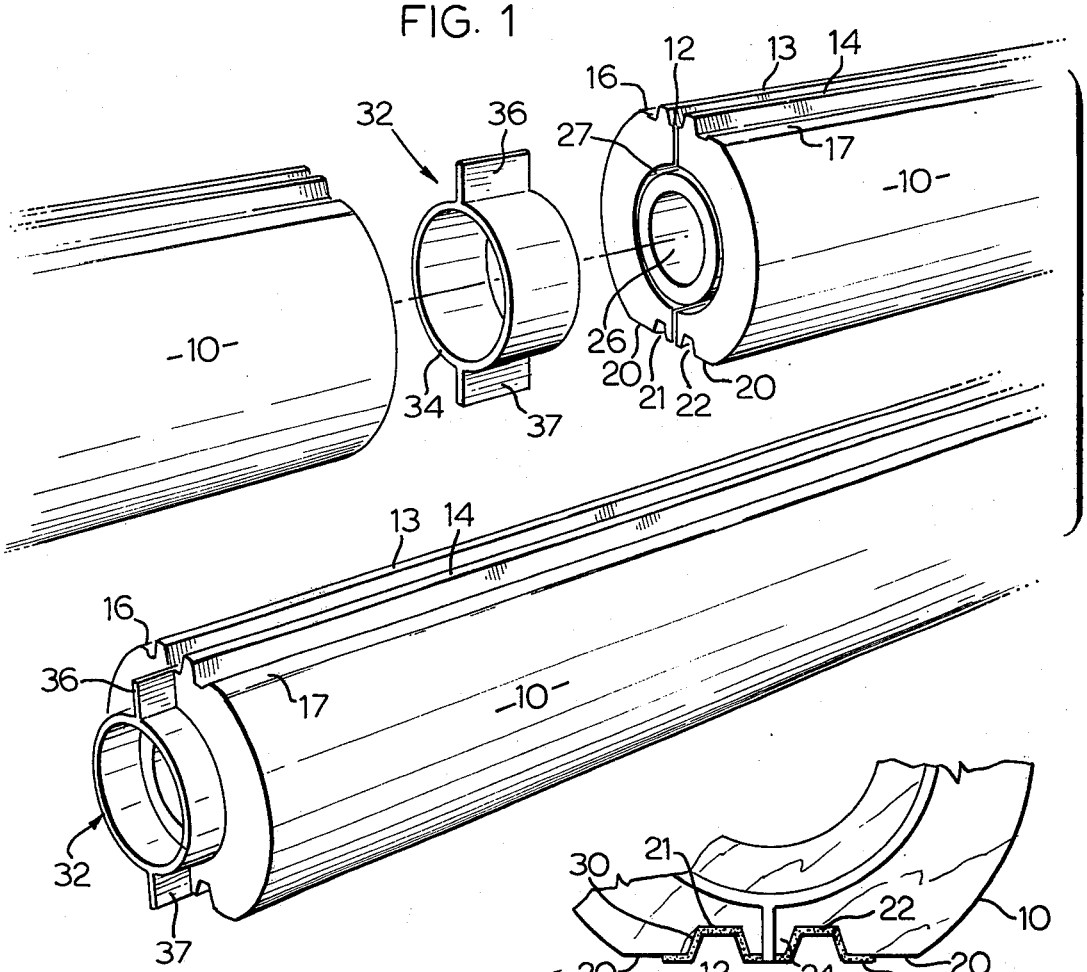
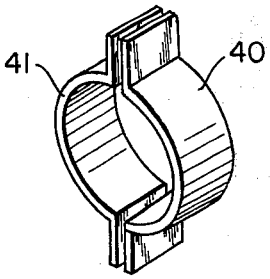
FIG.3
FIG. 2
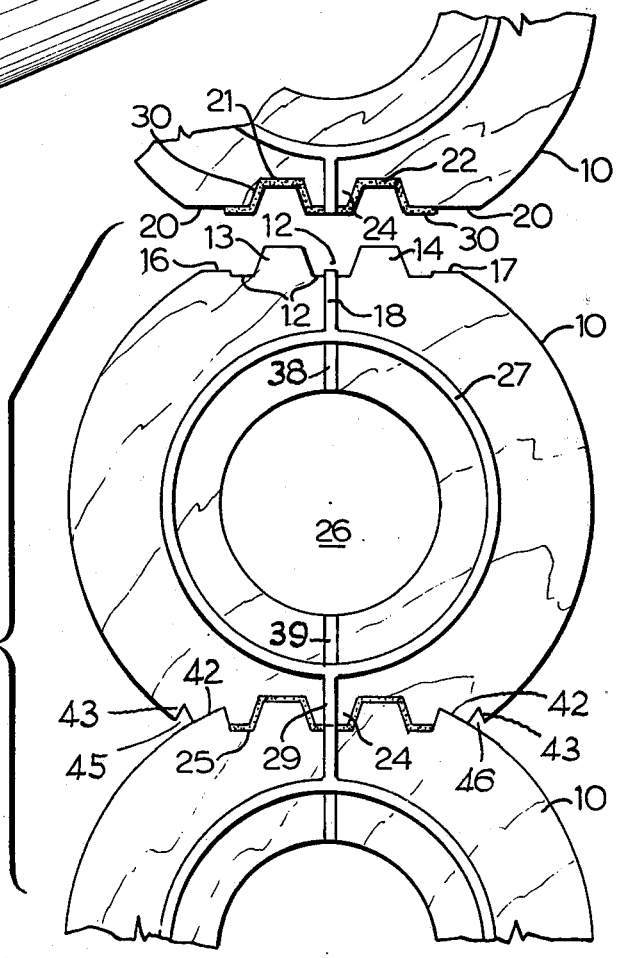

PREFABRICATED BUILDING LOG SECTIONS

This application is a continuation-in-part of application Ser. No. 467,340 filed May 6, 1974, now abandoned.

BACKGROUND OF THE INVENTION

This invention relates to a log structure for prefabricated log sections suitable for constructing log buildings.

In the construction of log buildings, prefabricated log sections are laid in a superposed manner to form walls. Commonly, complementary matching upper and lower longitudinal surface structures are provided on the log sections so that when the log sections are placed longitudinally and horizontally one on top of the other, the matching surface structures interfit with one another to join the log sections together. One form of such matching surface is provided by the formation of matching or complementary tongue-and-groove on the upper and lower surfaces of the log sections. The tongue-and-groove structure comprises a tongue extending the entire length of the log section and being formed on the upper surface therein, and a groove also extending the entire length of the log section and being formed in the lower surface therein. The tongue and the groove are dimensioned to interfit with each other snugly. However, such tongue-and-groove structure usually does not provide satisfactory joints between the log sections. This is primarily due to the difficulty in precisely forming the elongated tongue-and-groove on such relatively large structures. Therefore, often large gaps are present in the joints. This is further worsened by the tendency of the tongue to crack under changing weather conditions. Thus, air, vapour and moisture can pass through the joints formed by such interfitting surface structure. Normally, in order to eliminate such air and vapour leakages, a sealing material such as caulking compound is placed on the outside of the joints. The sealing material although eliminating the leakages, inherently destroys the aesthetic appearance of the wall and the log building as a whole. Furthermore, the sealing material often falls off easily from the joints due to the continual expansion and contraction of the log sections under changing weather conditions and the ossification of the sealing material due to prolonged exposure to the atmosphere.

In order to obviate the above problems, attempts have been made to place the sealing material within the joints. However, in order to achieve this the surface structure of the log sections is usually very complicated and the log sections are difficult and expensive to manufacture and time consuming to install.

Also, commonly the end-to-end joints between the log sections are formed by simply abutting the end surfaces of the log sections together and filling the joints with a sealing compound. Sometimes, complementary end structures are provided in the log sections to form scarf end joints between the sections. Again, due to the natural contraction and expansion of the log sections, such common end-to-end joints are far from satisfactory.

OBJECTS OF THE INVENTION

It is the principal object of the present invention to provide a prefabricated log section having a simple longitudinal surface structure such that the longitudinal joints between two of such log sections are weather-tight.

It is an object of the present invention to provide a prefabricated building log section having a simple end structure which provides a weather-tight end joint between two of such log sections.

It is another object of the present invention to provide a prefabricated building log section having a longitudinal center bore so as to provide an air core therein for insulation purposes.

It is still another object of the present invention to provide a prefabricated building log section which is easy to produce and install.

BRIEF SUMMARY OF THE INVENTION

The prefabricated building log according to the present invention primarily comprises a log section having a substantially flat longitudinal upper surface, a pair of spaced parallel longitudinal tongue members formed in the middle portion of the upper surface, the tongue members extending radially upward from the upper surface, two raised platforms formed on the longitudinal edge portions of the upper surface, the platforms having a substantially flat upper face, the log section also having a substantially flat longitudinal lower surface, a pair of spaced parallel longitudinal channels formed in the middle portion of the lower surface, the channels having a complementary cross sectional configuration equal to that of the tongue members and having cross sectional dimensions equal to or larger than that of the tongue members.

A center bore is formed in the log section, which extends throughout the entire length of the log section to provide a central longitudinal air core therein.

A circular groove is formed on the end surfaces of the log section. The circular groove is concentric with and circumscribes the center bore. Two radial grooves diametrically opposite to each other are extending from the circular groove to the upper surface and lower surface of the log section.

BRIEF DESCRIPTION OF THE DRAWINGS

These and other objects of the present invention together with its advantages will be more apparent from the following description and drawings, which illustrate specific embodiments by way of example and in which:

FIG. 1 is a perspective view of the log sections and the end-to-end coupler member according to the present invention;

FIG. 2 is a side elevation view of the log sections according to the present invention; and FIG. 3 is a perspective view of an alternative embodiment of the coupler according to the present invention.

DESCRIPTION OF PREFERRED EMBODIMENTS

Referring to the drawings, three log sections are shown in the perspective view in FIG. 1. Each log section 10 has a substantially flat upper surface 12 having a pair of upstanding elongated tongues 13 and 14 formed in its longitudinal middle portion and are substantially equidistant from the longitudinal center line of the upper surface. The tongues 13 and 14 are spaced and parallel from each other and they extend throughout the entire longitudinal length of the log section such that a central longitudinal groove 15 is defined by the tongues. The tongues preferably have a wedge-shaped cross sectional configuration with a larger base portion.

Two slightly raised platforms 16 and 17 are formed on the edge portions of the upper surface 12 of the log section. The raised platforms 16 and 17 have a substantially flat upper face.

A pair of longitudinal channels 21 and 22 are formed in the longitudinal middle portion of the lower surface 20 of the log section. The channels are formed in a spaced manner approximately parallel to each other and are substantially equidistant from the longitudinal center line of the lower surface. The distance is equal to the distance of the longitudinal tongues 13 and 14 from the longitudinal center line of the upper surface 12. The channels 21 and 22 also extend throughout the entire length of the log section. The central longitudinal tongue 24 is defined by the parallel channels 21 and 22. The channels 21 and 22 have a complementary cross sectional configuration to that of the tongues 13 and 14. The edge portions of the lower surface of the log section have a joint surface which has a configuration complementary to that of the raised platforms.

When two log sections are superposed together, the upper face of the raised platforms 16 and 17 on the upper surface of the lower log section will abut the rabbets in the edge portions of the lower surface of the upper log section. Due to the raised platforms, the tongues 13 and 14 will be spaced from the walls of the channels 21 and 22 to form an enclosed space or cavity 25 therebetween (as best shown in the joint between the bottom two log sections in FIG. 2). The width of the space 25 is equal to the height of the platforms 16 and 17 from the upper surface 12 of the log section. The channels 21 and 22 may be made deliberately with slightly larger cross sectional dimensions than that of the tongues 13 and 14 in order to ascertain that the space 25 will be formed in the joint. This provision will compensate for any imperfection or inaccurate formation of the channels and/or the tongues. Also, the tongues 13 and 14 may be provided with steep side walls such that the steep side walls will act as an alignment means when joining two log sections together.

A center bore 26 is formed in the log section 10. The center bore extends throughout the entire length of the log section so as to provide an air core or space within the log section. Such air core or space provides a desirable insulation medium in the wall formed by such log sections. It may also be used as a passageway for electrical cables or conduits.

A circular groove 27 is formed in each end surface of the log section. The circular groove is concentric with and circumscribes the end portions of the center bore 26. Two diametrically opposite radial grooves 28 and 29 extend outwards from the circular groove 27 to the middle of the central groove 15 of the upper surface and the middle of the central tongue 24 of the lower surface respectively. The radial grooves 28 and 29 may be formed by making two separate diametric cuts or they may be formed by simply making a single transverse diametric cut across the end surface of the log section. In the latter case, two grooves 38 and 39 extending from the circular groove 27 to the center bore 26 would inherently be formed such as that shown in the middle log section in FIG. 2.

Typically for example, the log section 10 may have a diameter of about 7 inches. With such a log section, the center bore 26 may be about 3 inches in diameter and the circular groove 27 may have an outer diameter of about 4.5 inches. The width of the circular groove and radial grooves 28 and 29 may be about one-eighth of an inch. The base of the tongues 13 and 14 and the upper width of the channels 21 and 22 may be about 0.75 inch. The width of the upper surface of the tongues 13 and 14 and the base surface of the channels 21 and 22 may be about 0.5 inch. The side walls of the tongues and the channels may have a slope of about 18° to 20°. The height of the tongues 13 and 14 and the depth of the channels 21 and 22 may be about 0.375 inch. The upper face of the raised platforms 16 and 17 may be about 0.063 inch above the upper surface 12.

In use, a layer of a sealing material 30 is provided on the surface of the channels 21 and 22 and the central tongue 24 of the lower surface of the upper log section. The sealing material 30 may be one of any known fluid type sealing compound or a sheet type compressible insulation material adhered to or otherwise provided on the lower surface of the log section. A polymeric sealing material may be used for this purpose. The sealing material will adhere to the wood surface of the two log sections to provide a structural bond as well as a weather-tight seal in the joint. The amount of sealing material to be spread within the joint is intended to sufficiently fill the space or cavity 25 so as to leave a slight deficiency therein. This will permit the tongues and/or the channels to expand or contract under changing weather conditions. Weather tightness is assured by the continuous bonds formed by the sealing material disposed between the top surface of the tongues and the bottom surface of the channels. Therefore, the expansion or contraction of the tongues or channels will not create any stresses in the joint to cause cracking in the log sections.

It will be understood that the sealing material may be provided on the surface of the tongues 13 and 14 and the central groove 12 of the lower log section instead of on the lower surface of the upper log section.

In accordance with the present invention, the end-to-end joints of the log sections are provided by a coupler 32. The coupler comprises an annular or tubular member 34 having a diameter equal to that of the circular groove 27 formed in the end surface of the log section, such that the annular member 34 is slidably receivable within the circular groove 27. Two diametrically opposite rectangular wing portions 36 and 37 extend radially outwards from the peripheral surface of the annular member 34. The wing portions 36 and 37 are adapted to be slidably receivable within the radial grooves 28 and 29 when the annular member 34 is received in the circular groove 27. Half of the width of the annular member 34 and the wing portions are slightly shorter than the depth of the circular groove and the radial grooves such that about half of the width of the coupler may be slidably secured in the circular groove and radial grooves of each log end as shown in the bottom log section in FIG. 1.

The wing portions 36 and 37 preferably are equal in length to each other and are equal to the length of the radial grooves 28 and 29 plus an additional length substantially equal to the height of the raised platforms 16 and 17. Thus, the free end of the wing portions 36 and 37 will extend beyond the upper and lower surfaces respectively when the coupler is secured in the end surface of the log section.

The coupler may be made of any suitable material such as plastics or sheet metal. Plastic material such as polyvinyl chloride (PVC) is preferred due to the low cost and ease in manufacture and the convenience in use and its low expansion modulus.

The coupler may be formed by two substantially U-shaped halves 40 and 41 as shown in FIG. 3, each of which is half of the coupler 32 and comprises a semi-annular portion with two flange portions extending radially outwardly from the free ends of the semi-annular portion. The flange portions form the wing portions of the coupler.

To join two log sections end-to-end together, a small amount of sealing material is first provided in the circular groove and radial grooves in the end surfaces of the two log sections. The coupler is then slidably secured into the circular groove and radial grooves of one log section, and the other log section is joined to the coupler by fitting the other half of the coupler within its circular groove and radial grooves until the two end surfaces of the log sections abut each other.

No vapour or air may pass through such end joint since the annular member and the wing portions provide a transverse barrier at the joint. The free ends of the wing portions will extend into the sealing material 30 in the longitudinal joints; thus no vapour or air may pass from the end joint to the longitudinal joints. With log sections having a diametric transverse cut, the grooves 38 and 39 will be sealed by the annular member 34 of the coupler.

Since the wing portions 36 and 37 extend beyond the upper and lower surface in a length about equal to the height of the platforms 16 and 17, this extended portion of the wing portions between two adjacent longitudinal log sections will be compressed by either the bottom surface of the central groove 15 or the top surface of the central tongue 24, the longitudinal joint in the neighbouring log sections to form an interference fitting. Such interference fitting compensates for any inaccuracy in the dimension or configuration in the tongue members or channels and/or the platforms of the two log sections. Also, the interference fitting between such end portions of the wing portions will ascertain that there is no gap between the coupler and adjacent upper and lower surfaces of the log sections.

Also, no vapour or air may pass from the end joints to the center bore since the annular member 34 of the coupler circumscribes the center bore.

It will be appreciated that since half of the width of the coupler is slightly shorter than the depth of the circular groove and the radial grooves, a space will exist between the side edges of the coupler and the bottom surfaces of the circular groove and the radial grooves of the two log sections joined together end-to-end. This space is occupied by the sealing material provided therein, therefore no air or vapour may pass through this space, and this space provides an allowance for the log sections to expand axially under changing weather conditions.

In a second embodiment, the raised platforms in the upper surface of the log section of the present invention may be extended portions of the side of the log section as shown by tenon portions 42 in the bottom log section shown in FIG. 2. The tenon portions 42 have a substantially triangular cross sectional shape having a curved upper surface. Two longitudinal mortise channels having complementary cross sectional configuration of that of the tenon portions are formed in the bottom edge portions of the log section. When the upper log section is superposed on the lower log section, the tenon portions of the lower log section will engage the mortise channels of the upper log section; the curved upper surface of the tenon portions will abut the curved surface of the mortise channels. An enclosed cavity 25 again is formed in the joint between the tongues 13 and 14 of the lower log section and the channels 21 and 22 of the upper log section.

Two additional longitudinal angle-cut channels 43 may be formed in the outside edge portion of the mortise channels as best shown in FIG. 2. With such a provision, when two log sections are superposed one on top of the other, two recessed longitudinal gaps 45 and 46 will be formed between the bottom longitudinal edge portions of the upper log section and the upper curved surface of the lower log section. The gaps 45 and 46 prevent any water such as rain water from entering the longitudinal joint. This phenomenon of rain water entering the longitudinal joint is prevalent in known structures in which the rain water will flow downwards on the surface of the log section to the longitudinal joint; and the water will enter the joint by capillary action. The water in the joint will cause the engaging surfaces to rot and deteriorate. With the formation of the longitudinal gaps 45 and 46 in the present invention, rain water will drip from the surface of the upper log section to the lower log section. Thus, no water can reach the engaging joint between the tenon portions and the mortise channels.

The embodiments which have been described are intended only to be illustrative of the inventive features involved; various other embodiments and modifications may be made by those skilled in the art without departing from the spirit and scope of the invention.

What I claim as new and desire to protect by Letters Patent of the United States is:

1. In a wall structure of a log building comprising at least two log sections joined together end-to-end, and said log sections being interfitted with at least a third log section in a superposed manner, each of said log sections and third log section having a pair of spaced parallel longitudinal tongue members formed in the upper surface therein, said tongue members defining a central upper groove extending throughout the entire longitudinal upper surface of the log section, two raised platforms formed on the longitudinal edge portions of the upper surface therein, a pair of spaced parallel longitudinal channels formed in the middle portion of the lower surface therein, said channels having a complementary cross-sectional configuration of that of said tongue members and having cross-sectional dimensions at least equal to or larger than the cross-sectional dimensions of said tongue members and said channels defining a central lower tongue extending throughout the entire longitudinal lower surface therein, two rabbets formed at the longitudinal edge portions of the lower surface therein, said rabbets having a configuration complementary to that of said raised platforms whereby said rabbets of at least one of said log sections interfit with said raised platforms of said third log section to form an enclosed space between the channels of said one of said log sections and the tongue members of said third log section, each of said log sections and third log section having a center bore extending throughout their respective entire longitudinal central portion, a circular groove formed at the end surfaces of each of said log sections and third log section, said circular groove encircling the end portions of said center bore therein, said circular groove having two diametrically opposite radial grooves extending radially outward from said circular groove and extending to the bottom surface of said central upper groove and central lower tongue respectively.

2. In a wall structure according to claim 1, including a coupler member slidably receivable within said circular groove of the adjoining end surfaces of the end-to-end joint of said log sections, said coupler member comprising an annular member having a diameter equal to that of said circular groove, two rectangular wing members extending radially outward from said annular member and said wing members being diametrically opposite to each other and being adapted to receive within said radial grooves, and said wing members having an equal length which is equal to each radial groove and an extended length substantially equal to the height of said raised platforms.

3. In a wall structure according to claim 2, wherein said coupler member has a width smaller than twice the depth of said circular groove and radial grooves in the end surfaces of said log sections.

4. A prefabricated building log according to claim 3, wherein one of said radial grooves extends from said circular groove to the middle portion of the bottom surface of said central upper groove, and the other radial groove extends from said circular groove to the middle portion of the bottom surface of said central lower tongue.

5. A prefabricated building log according to claim 3, wherein said tongue members have a wedge-shaped cross-sectional configuration having a wider base portion.

6. A prefabricated building log according to claim 3, including two additional diametrically opposite radial grooves extending from said circular groove to said center bore of each of said log sections whereby said radial grooves and said additional radial grooves form a transverse groove across the entire end surface of said log section.

7. A prefabricated building log according to claim 3, wherein said coupler member comprises two substantially U-shaped members each of which has a semi-annular portion and two radial flange portions extending radially outwardly from the free ends of said semi-annular portion.

8. A prefabricated building log suitable for constructing log buildings, comprising a log section having a pair of spaced parallel longitudinal tongue members formed in the middle portion of its upper surface, said tongue members defining a central upper groove extending throughout the entire longitudinal upper surface, two tenon portions formed in extensions of the longitudinal edge portions of said upper surface, a pair of spaced parallel longitudinal channels formed in the middle portion of the lower surface of said log section, said channels having a complementary cross sectional configuration to that of said tongue members and having cross sectional dimensions at least equal to or larger than that of said tongue members, and said channel defining a central lower tongue extending throughout the entire longitudinal lower surface of said log section, two mortise channels formed at the longitudinal edge portions of said lower surface, said mortise channels having a configuration complementary to that of said tenon portions whereby when said log section is interfitted in a superposed manner upon a second log section section having an identical structure, said mortise channels of said log section engage with the tenon portions of said second log section to form an enclosed space between said longitudinal channels of said log section and the longitudinal tongue members of said second log section, a center bore extending throughout the entire central longitudinal portion of said log section to provide an air core therein, a circular groove formed at each end surface of said log section, said circular groove being concentric to and circumscribing said center core, and two diametrically opposite radial grooves extending radially outward from said circular groove to the bottom surface of said central upper groove and the bottom surface of said central lower tongue respectively.

9. A prefabricated building log according to claim 8, wherein each of said mortise channels of said log section have an angle cut longitudinal channel formed in its outside edge portion whereby when two log sections are superposed together, two longitudinal recessed gaps are formed on the outside edge portion of the longitudinal joint to prevent water from entering the longitudinal joint by capillary action.

10. A prefabricated building log according to claim 9, wherein the upper surface of said longitudinal tongue members and the lower surface of said longitudinal channels of said log section both have a layer of sealing material provided thereon.

* * * * *